US011723450B2

(12) United States Patent
Bangalore Srinivas et al.

(10) Patent No.: US 11,723,450 B2
(45) Date of Patent: Aug. 15, 2023

(54) GLOVE FOR CLEANING OBJECTS

(71) Applicant: Tata Consultancy Services Limited, Mumbai (IN)

(72) Inventors: Venkatesh Prasad Bangalore Srinivas, Bangalore (IN); Shashi Kanth Veeramalla, Bangalore (IN); Raghav Ponnath, Bangalore (IN); Pradeep Prabhakar Kamble, Bangalore (IN)

(73) Assignee: TATA CONSULTANCY SERVICES LIMITED, Mumbai (IN)

( * ) Notice: Subject to any disclaimer, the term of this patent is extended or adjusted under 35 U.S.C. 154(b) by 196 days.

(21) Appl. No.: 17/446,728

(22) Filed: Sep. 2, 2021

(65) Prior Publication Data

US 2023/0013192 A1 Jan. 19, 2023

(30) Foreign Application Priority Data

Jun. 16, 2021 (IN) ..... 202121026945

(51) Int. Cl.
*A46B 13/02* (2006.01)
*A46B 5/04* (2006.01)
(Continued)

(52) U.S. Cl.
CPC ..... *A46B 13/02* (2013.01); *A46B 5/04* (2013.01); *A47L 17/00* (2013.01); *A46B 13/001* (2013.01);
(Continued)

(58) Field of Classification Search
CPC .. B08B 1/002; B08B 1/04; B08B 3/02; B08B 3/024; B08B 3/04; B08B 3/08;
(Continued)

(56) References Cited

U.S. PATENT DOCUMENTS

2004/0250333 A1 12/2004 Friedman
2017/0049076 A1* 2/2017 Takla ..... A01K 13/002
(Continued)

FOREIGN PATENT DOCUMENTS

| | | |
|---|---|---|
| CN | 209300323 | 8/2019 |
| KR | 102126472 B1 | 6/2020 |
| WO | WO2016056007 A2 | 4/2016 |

*Primary Examiner* — Orlando E Aviles
*Assistant Examiner* — Sharonda T Felton
(74) *Attorney, Agent, or Firm* — Finnegan, Henderson, Farabow, Garrett & Dunner LLP

(57) ABSTRACT

Conventionally, cleaning of objects has been proposed by use of gloves wherein objects need to be pre-washed manually. However, the level of cleaning is not spotless. Electric scrubbers have also been proposed in solving scrubbing problem but are not efficient. Embodiment of the present disclosure provide a glove that integrates a detachable power-driven scrubber. The power-driven scrubber is configured to controllably rotate in one or more directions based on an activation of a sensor to clean an object. The glove further includes sensing mechanisms for controlled flow of water discharge and controlled flow of cleansing fluid dispense that enables the detachable power-driven scrubber to clean the object. Rotation of the detachable power-driven scrubber is controlled and driven by a drive shaft that transmits rotary motion/torque generated by a motor coupled thereto. A scrubber locking strap is provided on the glove for lock and release of the detachable power-driven scrubber accordingly.

10 Claims, 13 Drawing Sheets

(51) Int. Cl.
*A47L 17/00* (2006.01)
*A46B 13/00* (2006.01)
*A46B 15/00* (2006.01)

(52) U.S. Cl.
CPC ... *A46B 15/0006* (2013.01); *A46B 2200/3033* (2013.01)

(58) Field of Classification Search
CPC .... A47L 1/05; A47L 11/04–085; A47L 11/26; A47L 11/28–284; A47L 13/18; A47L 13/19; A47L 13/26; A47L 17/04; A47L 21/00; A47L 21/02; A47L 21/04; A47L 25/00; A46B 13/02; A46B 13/04; A46B 13/00; A46B 2200/3033
USPC ..... 401/7, 8
See application file for complete search history.

(56) References Cited

U.S. PATENT DOCUMENTS

2018/0214586 A1* 8/2018 Louis ..... A47L 13/19
2018/0242796 A1* 8/2018 Moffitt ..... A46B 7/04

* cited by examiner

GLOVE FOR CLEANING OBJECTS

PRIORITY CLAIM

This U.S. patent application claims priority under 35 U.S.C. § 119 to: India Application No. 202121026945, filed on Jun. 16, 2021. The entire contents of the aforementioned application are incorporated herein by reference.

TECHNICAL FIELD

The disclosure herein generally relates to gloves, and, more particularly, to a glove for cleaning objects.

BACKGROUND

Washing and cleaning of objects is repetitive day to day task. Washing units available in the market may fail to clean objects properly and are very expensive There are many handheld scrubbing units that are available in the market. However, these scrubbing units have their own limitations and may not be suitable to do all functions. For instance, manual scrubbers in the form of gloves deal with only scrubbing job. Further, automation-based dishwashing gloves also do not address the cleaning problem fully. For instance, there could be some areas of the objects that are not easily reachable due to certain shape-specific constraints of the objects, and even if some of the available gloves manage to reach all areas of the objects they may still fail to clean the objects as desired due to limitations of these kind of gloves.

SUMMARY

Embodiments of the present disclosure present technological improvements as solutions to one or more of the above-mentioned technical problems recognized by the inventors in conventional systems. For example, in one aspect, there is provided a glove for cleaning one or more objects. The glove comprises a plurality of sensors positioned on at least one layer of the glove; a first finger fitted with a nozzle at a fingertip thereof, wherein the nozzle is configured to discharge water being facilitated by an inlet pipe connected to the nozzle, and wherein the flow of water is activated and controlled using a first sensor from the plurality of sensors; an outlet to dispense cleansing fluid comprised in a fluid chamber, the fluid chamber being mounted on the glove, wherein the cleansing fluid is released from the fluid chamber and controlled using a second sensor from the plurality of sensors; and at least one second finger configured to be inserted into a first detachable power-driven scrubber, wherein the first detachable power-driven scrubber is configured to controllably rotate in one or more directions based on an activation of a third sensor from the plurality of sensors to clean an object, and wherein the first detachable power-driven scrubber is configured to clean the object based on at least one of (i) discharge of controlled flow of water being facilitated by the nozzle using the first sensor from the plurality of sensors, and (ii) dispensing of controlled flow of the cleansing fluid from the outlet, using the second sensor from the plurality of sensors. In an embodiment, position of the outlet is oriented in at least one direction of the power-driven scrubber being operated.

In an embodiment, the first detachable power-driven scrubber comprises: a housing comprising a first end and a second end; a cutout configured to accommodate the at least one second finger; a hole that extends from the first end through the second end of the housing; a drive shaft to be inserted into the hole, wherein the drive shaft comprises a first end and second end; a first pulley and a second pulley mounted at the first end and the second end of the drive shaft respectively; a set of radial bearings, each radial bearing from the set of radial bearings is positioned between the first end and the second end of the housing and the drive shaft respectively, wherein the set of radial bearings are configured to hold the drive shaft in the housing; a set of grooves comprised on the first end and the second end of the housing; a set of strip bearings, each strip bearing from the set of strip bearings is fitted in a corresponding groove from the set of grooves; and an endless scrubber belt comprising a first side and a second side. The endless scrubber belt comprises a first timer belt and a second timer belt at the first side and the second side, respectively. Each of the first timer belt and the second timer belt comprises teeth. In an embodiment, the endless scrubber belt is driven by the first pulley and the second pulley.

In an embodiment, the drive shaft is connected to, and operated by a motor via a flexible transmission cable. The motor is configured to transmit rotary motion to the drive shaft to rotate in the one or more directions. In an embodiment, when the drive shaft rotates in the one or more directions the first pulley and the second pulley are configured to drive each of the first timer belt and the second timer belt such that the endless scrubber belt rotates or oscillates around the set of strip bearings to clean the object.

In an embodiment, the endless scrubber belt comprises a plurality of bristles.

In an embodiment, the movement of the endless scrubber belt triggers at least one of (i) rotation of the plurality of bristles, and (ii) formation of foam based on contact of the plurality of bristles with at least one of the controlled flow of water and the cleansing fluid.

In an embodiment, the first detachable power-driven scrubber further comprises a scrubber locking strap to lock and release the first detachable power-driven scrubber when the at least one second finger is inserted into or removed from the first detachable power-driven scrubber.

In an embodiment, the first detachable power-driven scrubber further comprises a connector that is configured to connect a second detachable power-driven scrubber.

In an embodiment, the connector comprises an enclosure comprising a pinion gear and a drive gear attached to the pinion gear. The pinion gear is coupled to the radial bearing comprised at the second end of the housing.

In an embodiment, rotation of the drive shaft enables driving motion of the pinion gear and the drive gear to enable rotation of the second detachable power-driven scrubber connected thereto for cleaning at least one of the object or another object.

In an embodiment, the glove further comprises at least a pair of lock nuts to lock the first pulley and the second pulley at the first end and the second end of the drive shaft, respectively.

In an embodiment, the first detachable power-driven scrubber further comprises one or more drain holes, wherein the one or more drain holes are configured to drain at least one of liquid particles and dirt particles deposited in the cutout.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this disclosure, illustrate exemplary embodiments and, together with the description, serve to explain the disclosed principles.

DETAILED DESCRIPTION

Figure 1A:
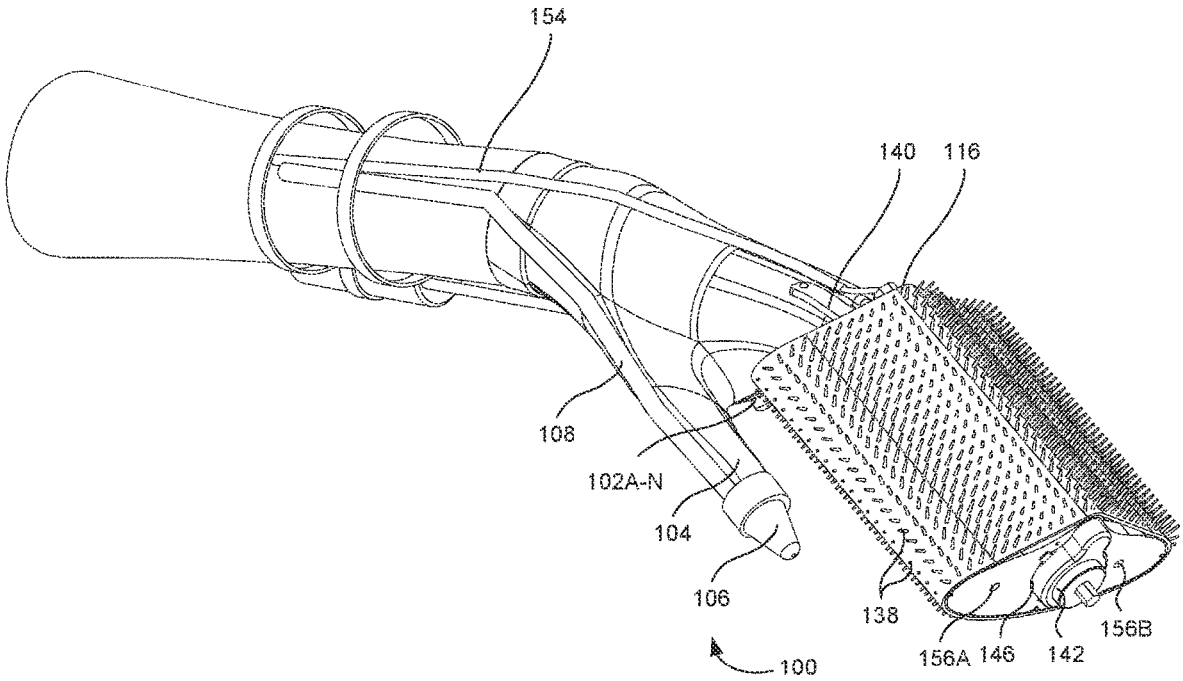
FIGS. 1A and 1B illustrate a perspective of a glove for cleaning one or more objects, in accordance with an embodiment of the present disclosure.

Exemplary embodiments are described with reference to the accompanying drawings. In the figures, the left-most digit(s) of a reference number identifies the figure in which the reference number first appears. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Conventionally, cleaning of objects has been proposed by use of gloves wherein objects need to be pre-washed manually. However, the level of cleaning is not spotless. Electric scrubbers have also been proposed in solving the scrubbing problem but are not efficient. There are many handheld scrubbing units that are available in the market. However, these scrubbers have their own limitations and may not be suitable to do all functions. For instance, manual scrubbers in the form of gloves deal with only scrubbing job. Further, automation-based dishwashing gloves do not address the cleaning problem fully. For instance, there could be some areas of the objects wherein reaching small areas are a challenging and cleaning the objects may not be possible as desired due to limitations of these gloves. For example, typically there are dish washers for cleaning utensils which are fully automatic machines. In some of the dishes wherein the content is struck in an unexpected region or in an unexpected manner, cleaning becomes challenging as the adherence is so high due to surface properties of the utensil and due to such constraints, the dish utensil does not get cleaned and manual cleaning in preferred way. Embodiment of the present disclosure provide a glove that integrates a detachable power-driven scrubber. The power-driven scrubber is configured to controllably rotate in one or more directions based on an activation of a sensor to clean an object. The glove further includes sensing mechanisms for controlled flow of water discharge and controlled flow of cleansing fluid dispense that enables the detachable power-driven scrubber to clean the object. Rotation of the detachable power-driven scrubber is controlled and driven by a drive shaft that transmits rotary motion/torque generated by a motor coupled thereto. A scrubber locking strap is provided on the glove for lock and release of the detachable power-driven scrubber accordingly.

Referring now to the drawings, and more particularly to FIGS. 1A through 6, where similar reference characters denote corresponding features consistently throughout the figures, there are shown preferred embodiments and these embodiments are described in the context of the following exemplary system and/or method.

Reference numerals of one or more components of the gripper apparatus as depicted in the FIGS. 1A through 6 are provided in Table 1 below for ease of description:

TABLE 1

| Sl. No | Component | Numeral reference |
|---|---|---|
| 1 | Glove | 100 |
| 2 | A plurality of sensors (first sensor, second Sensor, third Sensor . . . $N^{th}$ Sensor) | 102A-N |
| 3 | First finger | 104 |
| 4 | Nozzle | 106 |
| 5 | Inlet pipe | 108 |
| 6 | Outlet | 110 |
| 7 | Fluid chamber | 112 |
| 8 | Second finger | 114 |
| 9 | First detachable power-driven scrubber | 116 |
| 10 | Housing | 118 |
| 11 | First end and second end of the housing | 118A-B |
| 12 | Cutout | 120 |
| 13 | Hole | 122 |
| 14 | Drive shaft | 124 |
| 15 | First end and second end of the drive shaft | 124A-B |
| 16 | First pulley and second pulley | 126A-B |
| 17 | Set of radial bearings | 128A-B |
| 18 | Set of grooves | 130A-N |
| 19 | Set of strip bearings | 132A-N |
| 20 | Endless scrubber belt | 134 |
| 21 | First side and second side of the endless scrubber belt | 134A-B |
| 22 | First timer belt and second timer belt | 136A-B |
| 23 | Teeth | 137A-N |
| 24 | Plurality of bristles | 138 |
| 25 | Scrubber locking strap | 140 |
| 26 | Connector | 142 |
| 27 | Second detachable power-driven scrubber | 144 |
| 27 | Enclosure | 146 |
| 28 | Pinion gear | 148 |
| 29 | Drive gear | 150 |
| 30 | Pair of lock nuts | 152A-B |

TABLE 1-continued

| Sl. No | Component | Numeral reference |
|---|---|---|
| 31 | Flexible transmission cable | 154 |
| 32 | One or more drain holes | 156A-B |

Figure 1B:
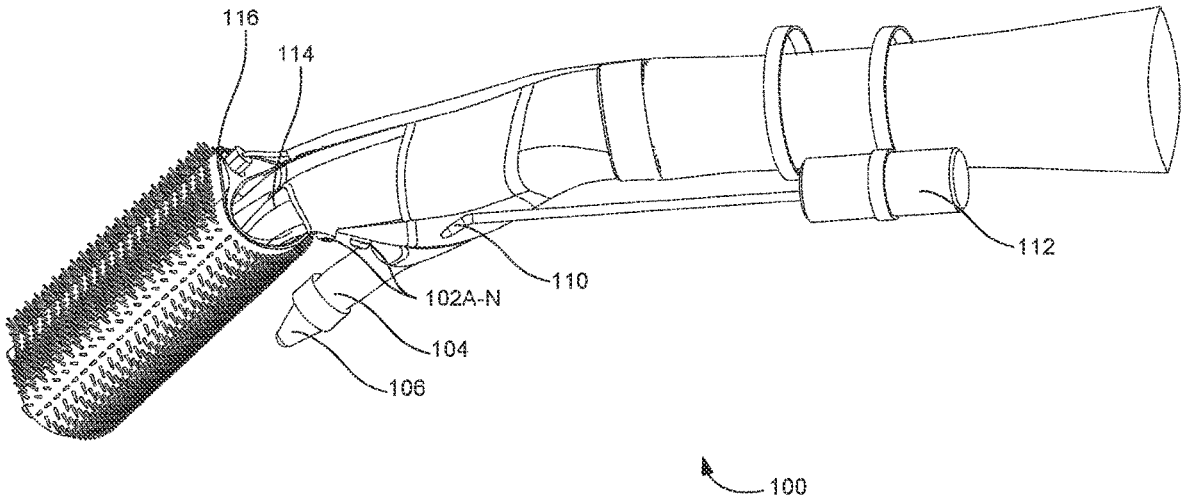
Figure 1C:
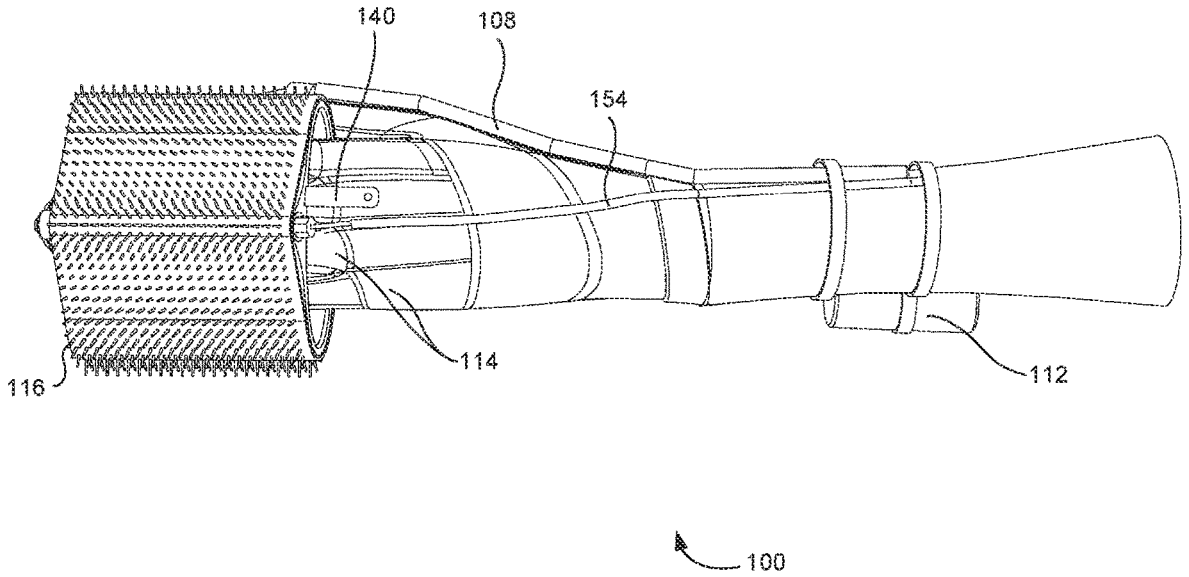
FIG. 1C illustrates a top view of the glove for cleaning one or more objects, in accordance with an embodiment of the present disclosure.
Figure 1D:
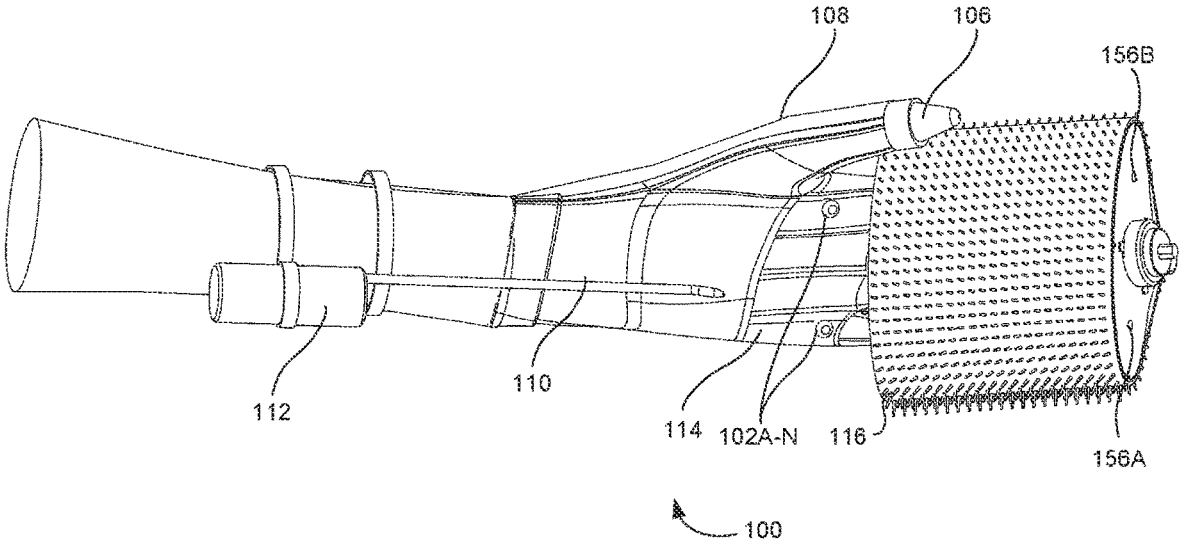
FIG. 1D illustrates a bottom view of the glove for cleaning one or more objects, in accordance with an embodiment of the present disclosure.

FIGS. 1A through 1D illustrate a glove 100 for cleaning one or more objects, in accordance with an embodiment of the present disclosure. More specifically, FIGS. 1A and 1B illustrate a perspective of the glove 100 for cleaning one or more objects, in accordance with an embodiment of the present disclosure. FIG. 1C, with reference to FIGS. 1A-1B, illustrates a top view of the glove 100 for cleaning one or more objects, in accordance with an embodiment of the present disclosure. FIG. 1D, with reference to FIGS. 1A-1C, illustrates a bottom view of the glove 100 for cleaning one or more objects, in accordance with an embodiment of the present disclosure. The glove 100 comprises a plurality of sensors 102A-N on at least one layer, in one example embodiment. For instance, the glove 100 comprise say a first surface (e.g., say an inner surface) and a second surface (e.g., say an outer surface). Therefore, based on the nature of the glove 100, the plurality of sensors 102A-N may be positioned on the inner surface or the outer surface having the at least one layer sandwiched between the inner and outer surfaces. In other words, the plurality of sensors 102A-N may be positioned within a layer formed between inside and outside of the glove 100. In such scenarios, the plurality of sensors 102A-N may be depicted by way of color coding (e.g., color patches, color press button, or any other suitable means for ease of identification of sensors and for enabling an activation of these sensors by receiving an input (e.g., a touch, a soft press, a hard press, a toggle, and the like)), one or more symbols (e.g., 'W' for activation and control of water discharge, and 'CF/G for activation and control of cleansing fluid/gel dispensing'), or soft buttons (e.g., a soft press or touch as mentioned above). The glove 100 further comprises a first finger 104 wherein the first finger 104 is fitted with a nozzle 106 at the fingertip. The nozzle 106 is further connected to an inlet pipe 108. The nozzle 106 discharges (or is configured to discharge) water being facilitated by the inlet pipe connected to the nozzle. In an embodiment of the present disclosure, the flow of water is activated and controlled using a first sensor (e.g., say water sensor) from the plurality of sensors 102A-N. The glove 100 further comprises an outlet 110 and a fluid chamber 112. The fluid chamber 112 stores cleansing fluid (also referred as 'gel', foam, liquid soap, or soap powder, or any cleaning agent and interchangeably used herein). The outlet 110 dispenses (or is configured to dispense) cleansing fluid comprised in the fluid chamber 112. In the present disclosure, the cleansing fluid is released from the fluid chamber 112 and controlled using a second sensor 102B from the plurality of sensors (102A-N). For instance, the fluid chamber 112 may have compression spring loaded piston (not shown in FIGS.) which keeps the flow of cleaning fluid under constant pressure due to spring force. Upon a trigger from the sensor (102B), the spring force may create the cleansing fluid to splash out of the outlet 110 for the required amount. For instance, the second sensor 1028 may also be referred as a cleaning agent releasing sensor and interchangeably used herein. The fluid chamber 112 can be re-filled once the cleaning agent gets empty or is less than a pre-defined quantity (e.g., say the capacity of the fluid chamber is 'x' grams (e.g., 20 grams) if a cleaning agent serves as a powder or 'y' ml (e.g., 50 ml) if the cleaning agent serves as a cleansing gel/form and the pre-defined threshold may be say 10 grams if powder is the cleaning agent and the pre-defined threshold can be say 10 ml if the cleaning agent is a gel/foam/liquid soap, and the like). The level of quantity of cleaning agent may be monitored using a level monitoring sensor (not shown in FIGS.), wherein the level monitoring sensor may communicate level of cleaning agent to an end user using the glove 100 for cleaning objects. Such communication may be triggered via one or more means of communication channels as known in the art (e.g., a text on a display associated with the fluid chamber 112, a level indication on the display itself, or a beep sound may be triggered) when the level of the cleaning agent is less than or equal to the pre-defined threshold. As depicted FIGS. 1A through 1D, the fluid chamber 112 is mounted on the glove 100. It is to be understood by a person having ordinary skill in the art or person skilled in the art that such mounting/positioning of the fluid chamber 112 shall not be construed as limiting the scope of the present disclosure.

The glove 100 further comprises at least one second finger 114 that is configured to be inserted into a first detachable power-driven scrubber 116 (also referred as a first power-driven scrubber and interchangeably used herein). As can be realized, a typical glove consists of sections to accommodate respective fingers of a hand. Therefore, it can be observed from FIGS. 1A through 1B, there are multiple fingers of the glove 100 which can be inserted into the first detachable power-driven scrubber 116. The first detachable power-driven scrubber 116 is configured to controllably rotate in one or more directions (e.g., forward direction, backward direction, or oscillates to and fro) based on an activation of a third sensor from the plurality of sensors 102A-N to clean an object. For instance, rotation/velocity/speed of the first detachable power-driven scrubber 116 may be controlled by a sensor (e.g., such as a dimmer stat or a potentiometer or a switch). More specifically, the first detachable power-driven scrubber 116 is configured to clean the object based on at least one of (i) discharge of controlled flow of water being facilitated by the nozzle 106 using the first sensor (e.g., water releasing sensor) from the plurality of sensors 102A-N, and (ii) dispensing of controlled flow of the cleansing fluid from the outlet 110, using the second sensor (e.g., say cleaning agent releasing sensor) from the plurality of sensors 102A-N. In one scenario, the first detachable power-driven scrubber 116 may use only the discharged water to clean the object. In another scenario, the first detachable power-driven scrubber 116 may use combination of discharged water and the dispensed cleansing fluid to clean the object. In yet another scenario, the first detachable power-driven scrubber 116 may not use either the water or cleansing fluid to clean the object. In other words, the first detachable power-driven scrubber 116 may be simply operated by a motor to clean the object instead of using water and the cleansing fluid to clean the object. It is to be understood by a person having ordinary skill in the art or person skilled in the art that such variations of use of water, cleansing fluid, and the like shall not be construed as limiting the scope of the present disclosure. Position of the outlet 110 is oriented in at least one direction of the first detachable power-driven scrubber 116 being operated, in one embodiment of the present disclosure. In an embodiment of the present disclosure, the expression 'clean', 'cleaning', 'cleanse', 'cleansing', and 'scrubbing' refer to cleaning or wiping or scrubbing the object to remove stains, spots, dirt and/or dust particles deposited thereof. Further, in another embodiment of the present disclosure, the expression 'clean', 'cleaning', 'cleanse', 'cleansing', and 'scrubbing' may be interchangeably used herein.

Figure 2A:
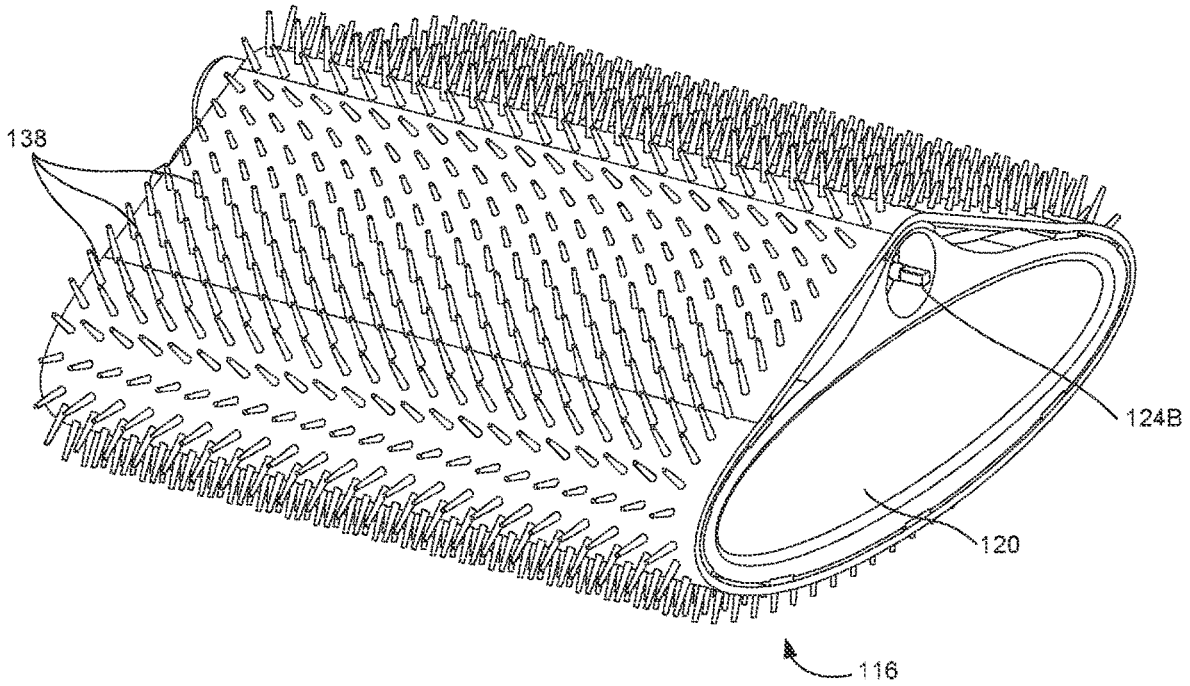
FIG. 2A illustrates a perspective view of a first detachable power-driven scrubber of the glove having a cutout, in accordance with an embodiment of the present disclosure.
Figure 2B:
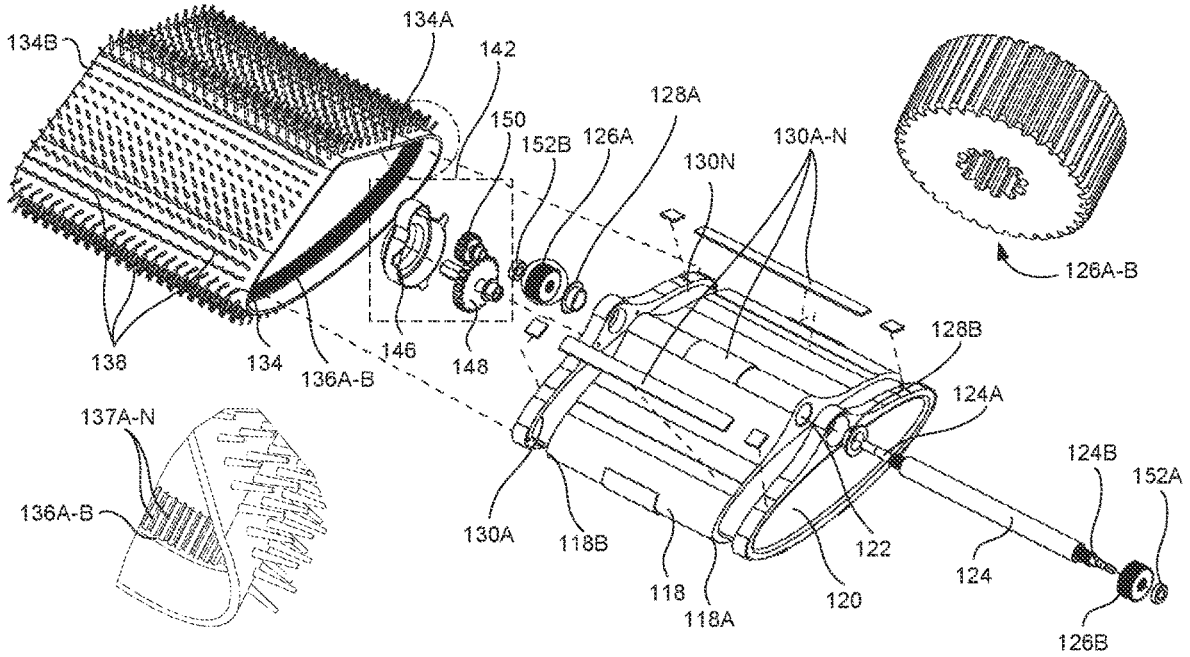
FIG. 2B illustrates an exploded view of the first detachable power-driven scrubber, in accordance with an embodiment of the present disclosure.
Figure 2C:
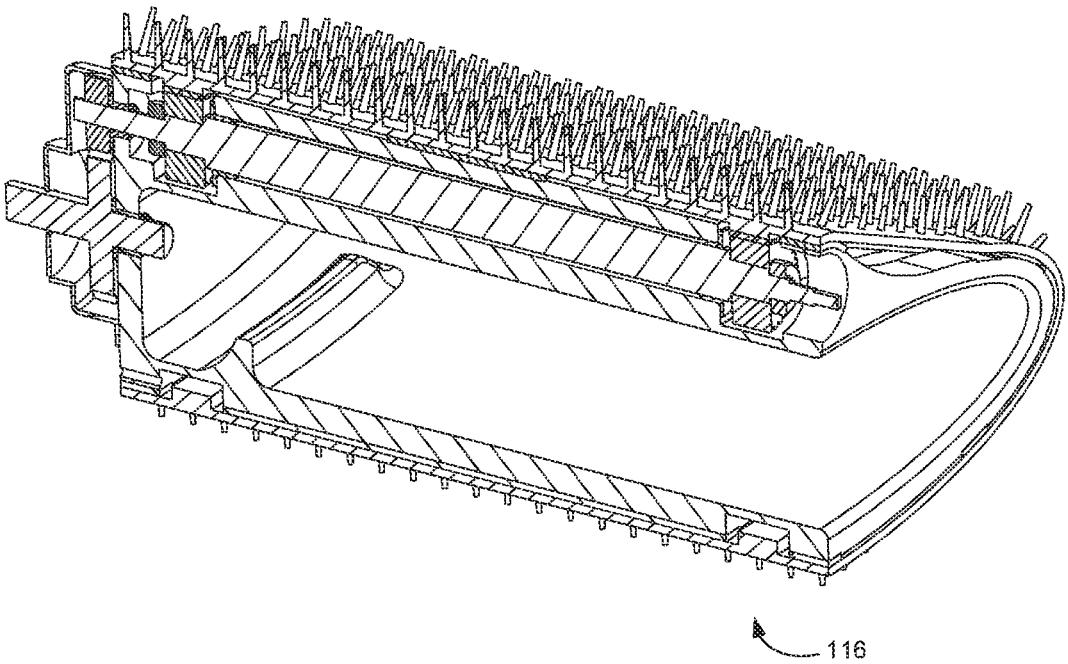
FIG. 2C illustrates a side sectional view of the first detachable power-driven scrubber, in accordance with an embodiment of the present disclosure.
Figure 2D:
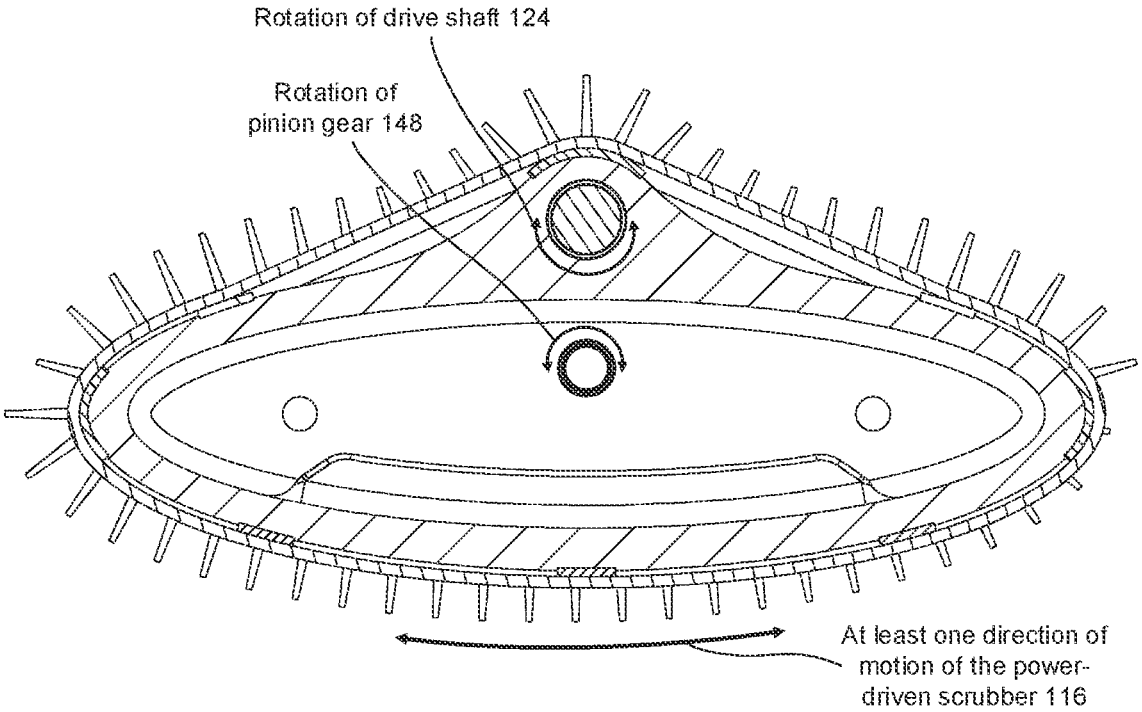
FIG. 2D illustrates a front sectional view of the first detachable power-driven scrubber, in accordance with an embodiment of the present disclosure.

The first detachable power-driven scrubber 116 comprises a housing 118 wherein the housing 118 comprises a first end 118A and a second end 118B. The first detachable power-driven scrubber 116 further comprises a cutout 120 (also referred as an oval shape hollow cylindrical space and interchangeably used herein. End users wearing the glove 100 can insert their fingers into respective sections (e.g., finger holders as known in the art) of the glove 100. Once inserted, the respective fingers can be inserted into the cutout 120 or oval shape hollow cylindrical space of the housing 118. FIGS. 1A through 1D depict an exemplary view of fingers inserted into the cutout 120. In other words, sections (e.g., finger holders) of the glove 100 are inserted into the cutout 120. The cutout 120 can be better understood and realized in its structure form in FIGS. 2A through 2D. More specifically, FIG. 2A, with reference to FIGS. 1A through 1D, illustrates a perspective view of the first detachable power-driven scrubber 116 having the cutout 120, in accordance with an embodiment of the present disclosure. FIG. 2B, with reference to FIGS. 1A through 2A, illustrates an exploded view of the first detachable power-driven scrubber 116, in accordance with an embodiment of the present disclosure. FIG. 2C, with reference to FIGS. 1A through 2B, illustrates a side sectional view of the first detachable power-driven scrubber 116, in accordance with an embodiment of the present disclosure. FIG. 2D, with reference to FIGS. 1A through 2C, illustrates a front sectional view of the first detachable power-driven scrubber 116, in accordance with an embodiment of the present disclosure.

The first detachable power-driven scrubber 116 further comprises a hole 122 that extends from the first end 118A through the second end 118B of the housing 118. The first detachable power-driven scrubber 116 further comprises a drive shaft 124 that is inserted (or to be inserted) into the hole 122. The drive shaft 124 comprises a first end 124A and a second end 124B. The first end 124A and the second end 124B may also be referred as first drive shaft end and second drive shaft end respectively for better understanding and clarity to distinguish in comparison to the first end 118A and the second end 118A of the housing 118. The first detachable power-driven scrubber 116 further comprises a first pulley 126A and a second pulley 126B. The first pulley 126A is mounted on (or fixed to) the first end 124A of the drive shaft 124 and the second pulley 126B is mounted on (or fixed to) the second end 124B of the drive shaft 124. The second pulley 126B is shown in solid line circle for which the exploded view of the second pulley 126B is shown at the top right side of FIG. 2B. It is to be understood since the first pulley 126A and the second pulley 126B are identical, similar depicted in solid circle for the first 126A is not shown and such non-depiction shall not be construed as limiting the scope of the present disclosure. The first detachable power-driven scrubber 116 further comprises a set of radial bearings 128A-B. Each radial bearing from the set of radial bearings 128A-B is positioned between the first end and the second end of the housing 118 and the drive shaft 124, respectively. For example, a first radial bearing say radial bearing 128A is positioned between the first end 118A of the housing 118 and the first end 124A of the drive shaft 124 and a second radial bearing say radial bearing 128B is positioned between the second end 118B of the housing 118 and the second end 124B of the drive shaft 124, respectively, as shown in FIG. 2B. Moreover, the set of radial bearings 128A-B are configured to hold the drive shaft 124 in the housing 118. In other words, the radial bearings 128A-B are responsible for firmly holding the drive shaft 124 in the housing 118 and refrain the drive shaft 124 from loose coupling, in one embodiment of the present disclosure.

The first detachable power-driven scrubber 116 further comprises a set of grooves 130A-N comprised on the first end 118A and the second end 118B of the housing 118. A set of strip bearings 132A-N are further provided in the first detachable power-driven scrubber 116 wherein each strip bearing from the set of strip bearings 132A-N is fitted in a corresponding groove from the set of grooves 130A-N. For instance, say the strip bearing 132A is fitted in the groove 130A and the strip bearing 132B is fitted in the groove 130B. It is to be understood by a person having ordinary skill in the art or person skilled in the art that instead of strip bearings, the first detachable power-drive scrubber 116 may comprise a set of roller bearings, and such implementation of bearing arrangements in the first detachable power-drive scrubber 116 shall not be construed as limiting the scope of the present disclosure. The first detachable power-driven scrubber 116 further comprises an endless scrubber belt 134 comprising a first side 134A and a second side 134B. The endless scrubber belt 134 comprises a first timer belt 136A and a second timer belt 136B at the first side 134A and the second side 134B respectively, as shown in FIG. 2B. Each of the first timer belt 136A and the second timer belt 136B comprises teeth 137A-N. The portion of the first timer belt 136A and the second timer belt 136B depicted in a broken and dotted line represented in circle is shown in an exploded view at the bottom left side of FIG. 2B wherein the teeth 137A-N are depicted. The endless scrubber belt 134 is driven by the first pulley 126A and the second pulley 126B, in one embodiment of the present disclosure. The endless scrubber belt 134 comprises a plurality of bristles 138. When the driven endless scrubber belt 134 is driven by the first pulley 126A and the second pulley 126B, movement of the endless scrubber belt 134 triggers (i) rotation of the plurality of bristles 138, and (ii) formation of foam based on contact of the plurality of bristles 138 with at least one of the controlled flow of water and the cleansing fluid. In some scenarios, as above mentioned if water and cleansing fluid are not utilized by the glove 100, then the movement of the endless scrubber belt 134 triggers only rotation of the plurality of bristles 138 to clean (or remove dust/dirt particles deposited on) the object.

Figure 3:
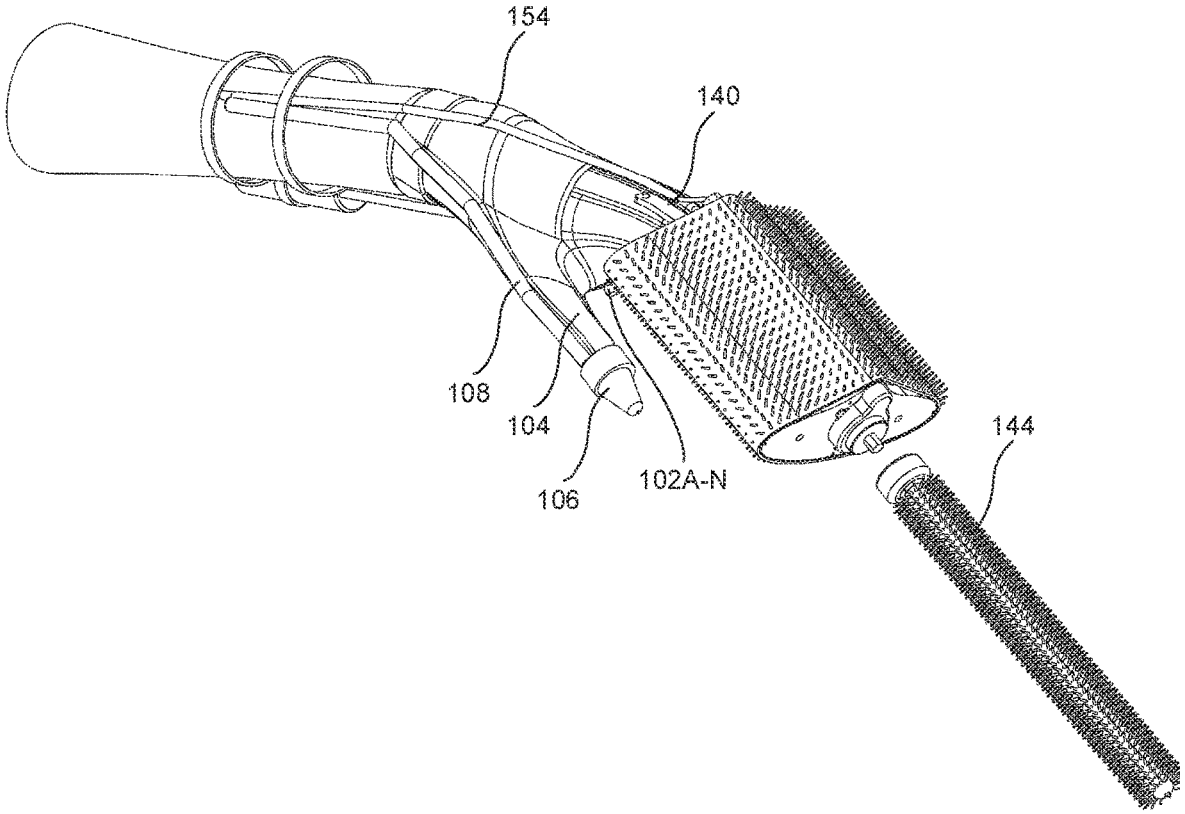
FIG. 3 illustrates a perspective view of the glove comprising the first detachable power-driven scrubber to be connected with a second detachable power-driven scrubber, in accordance with an embodiment of the present disclosure.

The first detachable power-driven scrubber 116 further comprises a scrubber locking strap 140 (also referred as locking and releasing unit and interchangeably used herein) to lock and release the first detachable power-driven scrubber 116 when the at least one second finger 114 is inserted into or removed from the cutout 120 of the first detachable power-driven scrubber 116. Furthermore, the first detachable power-driven scrubber 116 further comprises a connector 142. The connector 142 and components comprised in the connector 142 are depicted in a broken line representation block as shown in FIG. 2B. The connector 142 is configured to connect another detachable power-driven scrubber 144 (also referred as a second power-driven scrubber or a second detachable power-driven scrubber 144 and interchangeably used herein). FIG. 3, with reference to FIGS. 1A through 2D, illustrates a perspective view of the glove 100 comprising a first detachable power-driven scrubber to be connected with a second detachable power-driven scrubber, in accordance with an embodiment of the present disclosure. It is to be understood by a person having ordinary skill in the art or person skilled in the art that the size, shape, and other specifications of the detachable power-driven scrubbers as implemented and described herein shall not be construed as limiting the scope of the present disclosure. The second detachable power-driven scrubber may or may not be connected to the first detachable power-driven scrubber. For instance, the second detachable power-driven scrubber may be connected to the first detachable power-driven scrubber in case the first detachable power-driven scrubber is unable to reach an area of the object and clean it. In such scenarios, an end user wearing the glove 100 may utilize both the second detachable power-driven scrubber connected to the first detachable power-driven scrubber such that required/desired areas of the object are reached, and dust/dirt particles are removed either by use of the plurality of bristles 138 or in combination with water and/or the cleansing fluid. This ensures the object is cleaned in a desired manner. One example, where such arrangement of the second detachable power-driven scrubber connected to the first detachable power-driven scrubber can be realized is during cleaning of a drinking bottle. The top of the drinking bottle may be cleaned using the first second detachable power-driven scrubber, however, it may not be possible to clean the interior of the drinking bottle. For cleaning the interiors, the second detachable power-driven scrubber can be connected to the first detachable power-driven scrubber and the second detachable power-driven scrubber can be operated to rotate in desired direction(s) to clean the interiors of the drinking bottle. It is to be understood by a person having ordinary skill in the art or person skilled in the art that the above example of cleaning the drinking bottle shall not be construed as limiting the scope of the present disclosure. In other words, such arrangement can also be used to clean any other objects (e.g., utensils, tables, glass materials, and the like.).

Referring to FIG. 2B, the connector 142 comprises an enclosure 146. Structure/design of the enclosure 146 is such that it is configured to accommodate a pinion gear 148 and a drive gear 150. Further, the pinion gear 148 is coupled to the radial bearing 128B comprised at the second end 118B of the housing 118. Rotation of the drive shaft 124 enables driving motion of the pinion gear 148 and the drive gear 150 to enable rotation of the second detachable power-driven scrubber 144 connected thereto (connected to the first detachable power-driven scrubber 116) for cleaning at least one of the object or another object. In an embodiment of the present disclosure, the drive gear 150 is attached/coupled to the pinion gear 148 for generating a rotary motion for rotating the second detachable power-driven scrubber when operated via the first second detachable power-driven scrubber using a motor. The rotary motion is generated by the drive shaft 124 when operated via the motor.

The first detachable power-driven scrubber 116 further comprises at least a pair of lock nuts 152A-B to lock the first pulley 126A and the second pulley 126B at the first end 124A and the second end 124B of the drive shaft 124, respectively. In other words, the first lock nut 152A is configured to lock the first pulley 126A being mounted at the first end 124A of the drive shaft 124 and the second lock nut 152A is configured to lock the second pulley 126B being mounted at the first end 124A of the drive shaft 124. Moreover, the drive shaft 124 is connected to, and operated by a motor (not shown in FIGS. 1A through 3) via a flexible transmission cable 154. The motor is configured to transmit rotary motion to the drive shaft 124 to rotate in the one or more directions. When the drive shaft 124 rotates in the one or more directions the first pulley 126A and the second pulley 126B drive each of the first timer belt 136A and the second timer belt 136B such that the endless scrubber belt 134 rotates or oscillates around the set of strip bearings 132A-N to clean the object. The motor generates torque to drive the drive shaft 124. The torque is transmitted via (i) the teeth 137A-N comprised in each of the first timer belt 136A and the second timer belt 136B and the (ii) first and second pulley 126A-B to rotate the endless scrubber belt 134. Further, the torque generated by the motor is transmitted by the drive gear 150 via the pinion gear 148 to enable rotation of the second detachable power-driven scrubber 144 when in use to clean object(s). FIG. 2D depicts rotation of the drive shaft 124, rotation of pinion gear 148 and at least one direction of motion of the first detachable power-driven scrubber 116.

Figure 4:
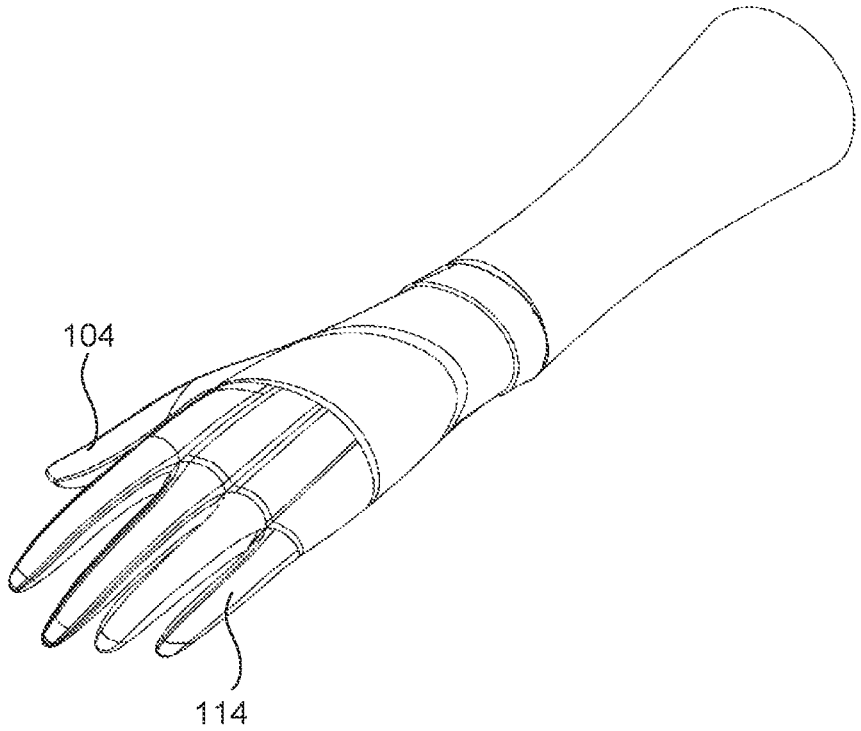
FIG. 4 illustrates the glove without a power-driven scrubber, in accordance with an embodiment of the present disclosure.

FIG. 4, with reference to FIGS. 1A through 3, illustrates the glove without a power-driven scrubber, in accordance with an embodiment of the present disclosure.

Figure 5A:
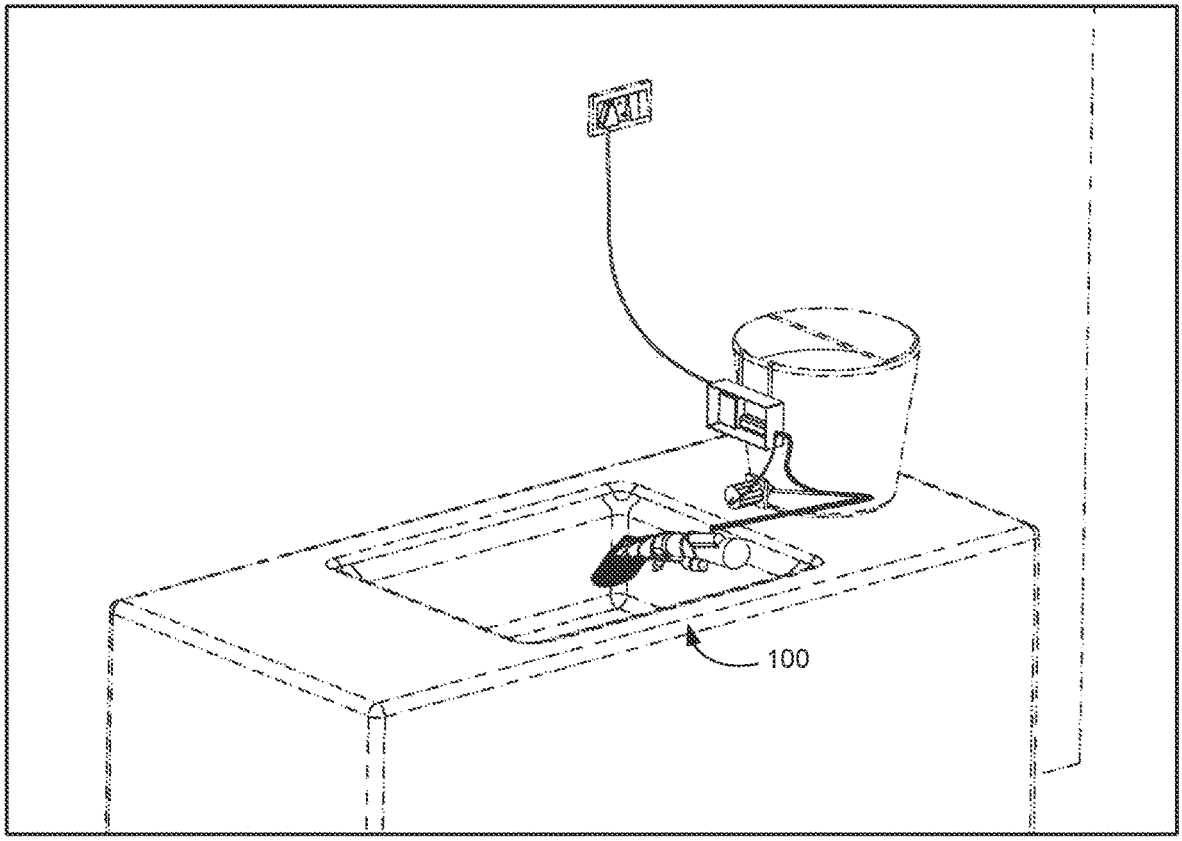
FIG. 5A depicts an exemplary first use case scenario illustrating a motor and pump mechanism powered via a mains supply to facilitate water to a nozzle via the inlet pipe for controlled flow of water to clean the object, in accordance with an embodiment of the present disclosure.
Figure 5B:
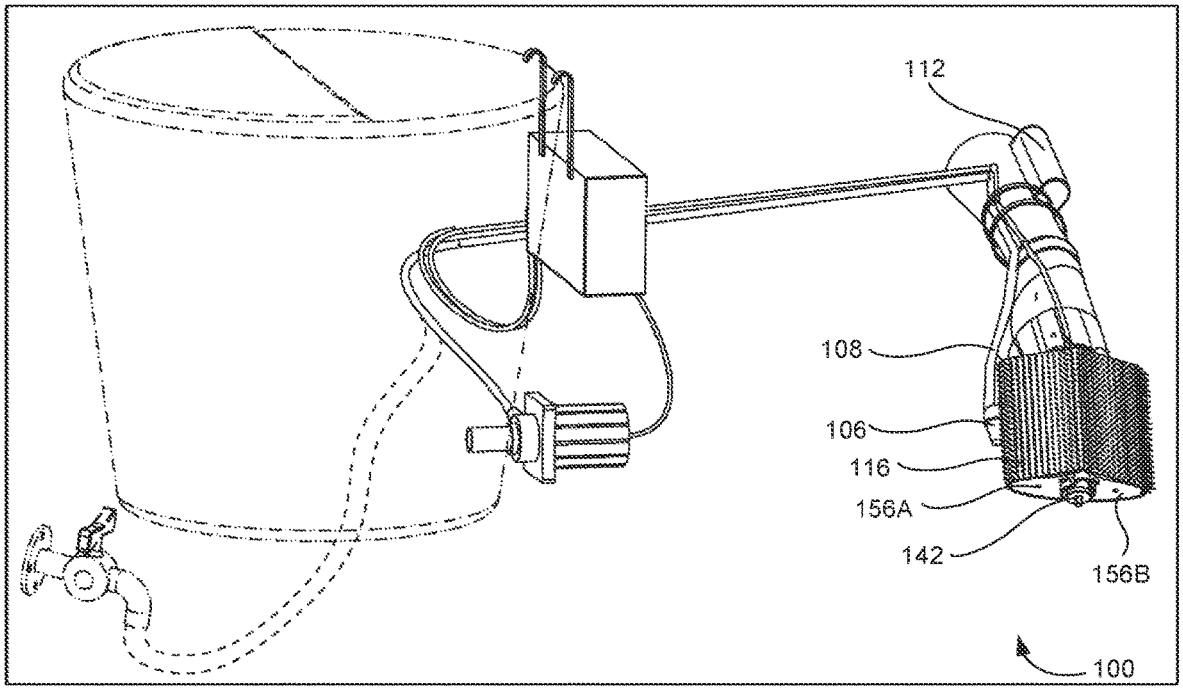
FIG. 5B depicts an exemplary second use case scenario illustrating a tap arrangement to facilitate water to the nozzle via the inlet pipe for controlled flow of water to clean the object, in accordance with an embodiment of the present disclosure.

Moreover, in an embodiment of the present disclosure, to clean the object water may be facilitated from a water container, wherein a motor and pump mechanism may be implemented by the present disclosure to pump the water from the water container (e.g., such as a bucket) to the inlet pipe 108 which facilitates to the nozzle 106. The motor may be supplied power via mains supply of a premise (e.g., say power unit at a kitchen) to enable pumping of water from the container and facilitate the water through the inlet pipe 108 at the nozzle 106. The nozzle 106 along with the motor and pump mechanism may serve as a jet spray unit and control the flow of water through the nozzle 106 for cleaning the object(s). FIG. 5A, with reference to FIGS. 1A through 4, illustrates an exemplary first use case scenario of the glove 100 for cleaning object(s), in accordance with an embodiment of the present disclosure. More specifically, FIG. 5A depicts an exemplary first use case scenario illustrating a motor and pump mechanism powered via a mains supply to facilitate water to the nozzle 106 via the inlet pipe 108 for controlled flow of water to clean the object, in accordance with an embodiment of the present disclosure. The motor may also be accommodated/mounted on the glove 100 depending upon its specification and size. Alternatively, the water may be supplied directly through a tap kind of an arrangement, wherein the inlet pipe 108 is directly connected to the tap for receiving water from a reservoir (e.g., tank). The tap angle may be adjusted accordingly to control the flow of water. Alternatively, the tap may be fully turned on and the water flow may be controlled via a sensor (e.g., the first sensor 102A) on the glove 100. With the use of tap arrangement, the present disclosure eliminates the need of motor and pump mechanism for facilitating water to the nozzle 106. FIG. 5B, with reference to FIGS. 1A through 5A, depicts an exemplary second use case scenario illustrating a tap arrangement to facilitate water to the nozzle 106 via the inlet pipe 108 for controlled flow of water to clean the object, in accordance with an embodiment of the present disclosure. Though FIGS. depict motor is driven and powered via mains supply/supply mains, it is to be understood by a person having ordinary skill in the art or person skilled in the art motor in such use case scenarios can also be powered by batteries or any other suitable powering means (or powering units).

Similarly, motor driving the drive shaft 124 for controlled rotation of the first detachable power-driven scrubber 116 may be powered by batteries or any other suitable powering means (or powering units), thus making the glove 100 compact and portable apparatus. Further, the glove 100 may be customized or designed to incorporate (rechargeable) battery(ies) (or mount battery(ies)) on the surface of the glove 100 to operate the motor/drive shaft and generate rotary motion for the first detachable power-driven scrubber 116 for rotation/oscillation. Though the battery(ies) are not shown in FIGS., it is to be understood by a person having ordinary skill in the art or person skilled in the art that glove 100 may comprise battery(ies) and such arrangement/customization of the glove 100 shall not be construed as limiting the scope of the present disclosure. The position of the battery(ies) on the glove 100 may be such that the glove 100 may be incorporated with one or more pins to recharge the battery(ies) when needed. Position of the pins may be such that the glove 100 may be docked into a charging unit (not shown in FIGS.) to charge the battery(ies) to provide power to the first detachable power-driven scrubber 116. One end of the pins may be in contact with corresponding pins/powering elements of the charging unit and other end of the pins may be in contact or connected to the battery(ies) for charging the battery(ies) comprised therein.

Further, the first detachable power-driven scrubber 116 further comprises one or more drain holes 156A-B at one end of the housing 118. The one or more drain holes 156A-B are configured to drain at least one of liquid particles and dirt particles deposited in the cutout 120. The liquid particles, such as water, cleansing fluid, foam formed during cleaning the objects, may be accumulated in the cutout 120 either during the use of the glove 100 or when not in use. Similarly, dirt particles may be deposited in the cutout 120 either during the use of the glove 100 or when not in use. The drain holes 156A-B enable removing of the liquid particles and/or dirt particles, in one example embodiment.

Figure 6:
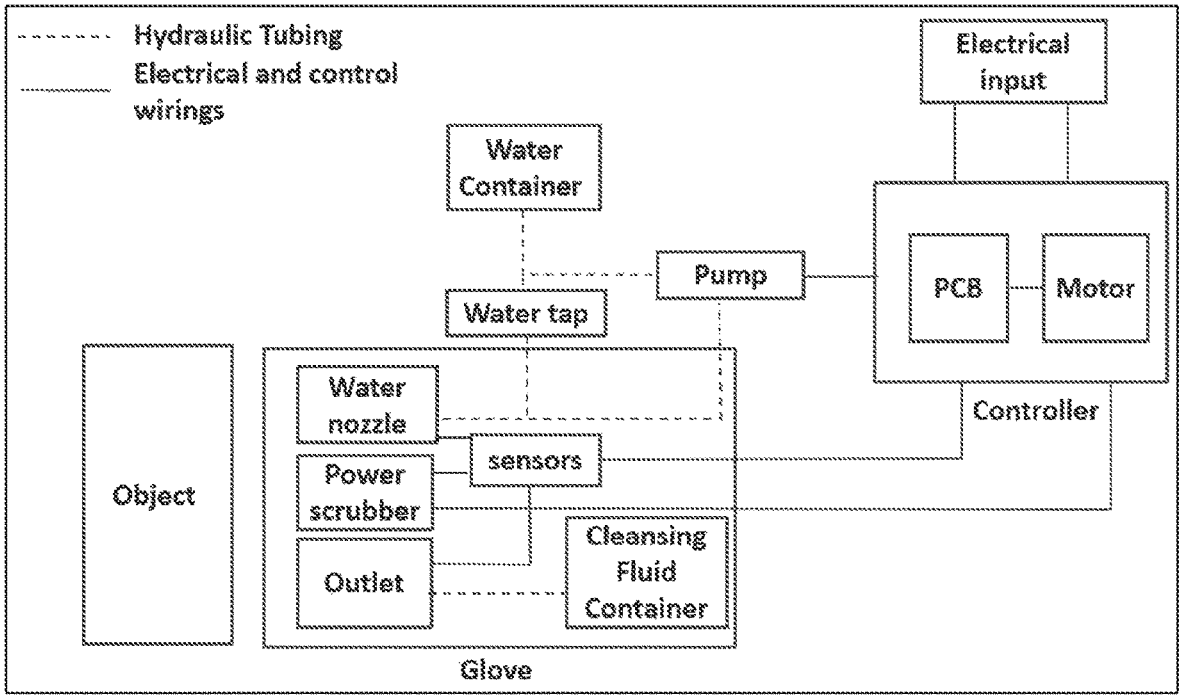
FIG. 6 illustrates an overall workflow of cleaning objects via the glove, in accordance with an embodiment of the present disclosure.

FIG. 6, with reference to FIGS. 1A through 5B, illustrates an overall workflow of cleaning objects via the glove 100, in accordance with an embodiment of the present disclosure. FIG. 6 may be described in 2 parts. Firstly, the glove 100 and second part is the controller as shown. Components of the glove 100 and their functionalities and connectivity with other components are described above. The controller may comprise a printed circuit board (PCB) and a motor. The nozzle 106 is triggered by activating a sensor on the glove 100 which sends response to the PCB in the controller. The controller may send input/instructions to the pump for delivering water to the nozzle 106 through the inlet pipe 108 (also referred as inlet, water tube/tube and interchangeably used herein), wherein the speed/flow of the water can be controlled accordingly. The pump can be used to facilitate water from any water sources nearby such as a bucket or water pipeline connection or tap arrangement(s). Further, when the at least one second finger 114 or remaining three/four fingers) are inserted the first detachable power-driven scrubber 116, it sends signal to a sensor which instructions in the form of feedback to the PCB for switching on/off for activating/deactivating rotation of the first detachable power-driven scrubber 116 via a sensor (e.g., a third sensor—not shown in FIGS.). Presence of fingers may enable trigger the sensors wherein motor is turned ON via a sensor/switch (either automatically or manually) to operate the motor. The motor then generates torque which transmits to the drive shaft 124 that further transmits rotary motion responsible for rotation/oscillation of the first detachable power-driven scrubber 116. In an embodiment of the present disclosure, the hydraulic tubing/connections are depicted by via of broken line representation and the electrical and control wiring(s)/connection(s) is/are depicted in solid line representation as shown in FIG. 6.

In an embodiment, the present disclosure may implement one or more motors to enable the first and second detachable power-driven scrubbers 116 and 144 clean the object. The one or more motors as described herein may either be an integral part of the glove 100 or be externally connected to the glove 100 via the controller as depicted in FIG. 6, in one example embodiment. Similarly, battery(ies) described herein may either be an integral part of the glove 100 or be externally connected to the glove 100 to provide power for the glove 100 and the drive shaft 100 that enables rotation of the first and second detachable power-driven scrubbers 116 and 144, in one example embodiment.

The written description describes the subject matter herein to enable any person skilled in the art to make and use the embodiments. The scope of the subject matter embodiments is defined by the claims and may include other modifications that occur to those skilled in the art. Such other modifications are intended to be within the scope of the claims if they have similar elements that do not differ from the literal language of the claims or if they include equivalent elements with insubstantial differences from the literal language of the claims.

It is to be understood that the scope of the protection is extended to such a program and in addition to a computer-readable means having a message therein; such computer-readable storage means contain program-code means for implementation of one or more steps of the method, when the program runs on a server or mobile device or any suitable programmable device. The hardware device can be any kind of device which can be programmed including e.g., any kind of computer like a server or a personal computer, or the like, or any combination thereof. The device may also include means which could be e.g., hardware means like e.g., an application-specific integrated circuit (ASIC), a field-programmable gate array (FPGA), or a combination of hardware and software means, e.g., an ASIC and an FPGA, or at least one microprocessor and at least one memory with software processing components located therein. Thus, the means can include both hardware means and software means. The method embodiments described herein could be implemented in hardware and software. The device may also include software means. Alternatively, the embodiments may be implemented on different hardware devices, e.g., using a plurality of CPUs.

The embodiments herein can comprise hardware and software elements. The embodiments that are implemented in software include but are not limited to, firmware, resident software, microcode, etc. The functions performed by various components described herein may be implemented in other components or combinations of other components. For the purposes of this description, a computer-usable or computer readable medium can be any apparatus that can comprise, store, communicate, propagate, or transport the program for use by or in connection with the instruction execution system, apparatus, or device.

The illustrated steps are set out to explain the exemplary embodiments shown, and it should be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed. Alternatives (including equivalents, extensions, variations, deviations, etc., of those described herein) will be apparent to persons skilled in the relevant art(s) based on the teachings contained herein. Such alternatives fall within the scope of the disclosed embodiments. Also, the words "comprising," "having," "containing," and "including," and other similar forms are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., be non-transitory. Examples include random access memory (RAM), read-only memory (ROM), volatile memory, nonvolatile memory, hard drives, CD ROMs, DVDs, flash drives, disks, and any other known physical storage media.

It is intended that the disclosure and examples be considered as exemplary only, with a true scope and spirit of disclosed embodiments being indicated by the following claims.

What is claimed is:

1. A glove for cleaning one or more objects, the glove comprising:

a plurality of sensors positioned on at least one layer of the glove;

a first finger fitted with a nozzle at a fingertip thereof, wherein the nozzle is configured to discharge water being facilitated via an inlet pipe connected to the nozzle, and wherein the flow of water is activated and controlled using a first sensor from the plurality of sensors;

an outlet to dispense cleansing fluid comprised in a fluid chamber, the fluid chamber being mounted on the glove, wherein the cleansing fluid is released from the fluid chamber and controlled using a second sensor from the plurality of sensors; and at least one second finger configured to be inserted into a first detachable power-driven scrubber, wherein the first detachable power-driven scrubber is configured to controllably rotate in one or more directions based on an activation of a third sensor from the plurality of sensors to clean an object, wherein the first detachable power-driven scrubber comprises:

a housing comprising a first end and a second end;

a cutout configured to accommodate the at least one second finger;

a hole that extends from the first end through the second end of the housing;

a drive shaft to be inserted into the hole, wherein the drive shaft comprises a first end and second end;

a first pulley and a second pulley mounted at the first end and the second end of the drive shaft, respectively;

a set of radial bearings, each radial bearing from the set of radial bearings is positioned between the first end and the second end of the housing and the drive shaft respectively, wherein the set of radial bearings are configured to hold the drive shaft in the housing;

a set of grooves comprised on the first end and the second end of the housing;

a set of strip bearings, each strip bearing from the set of strip bearings is fitted in a corresponding groove from the set of grooves; and an endless scrubber belt comprising a first side and a second side, wherein the endless scrubber belt comprises a first timer belt and a second timer belt at the first side and the second side respectively, wherein each of the first timer belt and the second timer belt comprises teeth, and wherein the endless scrubber belt is driven by the first pulley and the second pulley, and wherein the first detachable power-driven scrubber is configured to clean the object based on at least one of (i) discharge of controlled flow of water being facilitated by the nozzle using the first sensor from the plurality of sensors, and (ii) dispensing of controlled flow of the cleansing fluid from the outlet, using the second sensor from the plurality of sensors.

2. The glove of claim 1, wherein the drive shaft is connected to, and operated by a motor via a flexible transmission cable, wherein the motor is configured to transmit rotary motion to the drive shaft to rotate in the one or more directions, and wherein when the drive shaft rotates in the one or more directions the first pulley and the second pulley are configured to drive each of the first timer belt and the second timer belt such that the endless scrubber belt rotates or oscillates around the set of strip bearings to clean the object.

3. The glove of claim 1, wherein the endless scrubber belt comprises a plurality of bristles.

4. The glove of claim 3, wherein the movement of the endless scrubber belt triggers at least one of (i) rotation of the plurality of bristles, and (ii) formation of foam based on contact of the plurality of bristles with at least one of the controlled flow of water and the cleansing fluid.

5. The glove of claim 1, wherein the first detachable power-driven scrubber further comprises:

a scrubber locking strap to lock and release the detachable power-driven scrubber when the at least one second finger is inserted into or removed from the detachable power-driven scrubber.

6. The glove of claim 1, wherein the first detachable power-driven scrubber further comprises a connector configured to connect a second detachable power-driven scrubber.

7. The glove of claim 4, wherein the connector comprises:

an enclosure comprising a pinion gear and a drive gear attached to the pinion gear, wherein the pinion gear is coupled to the radial bearing comprised at the second end of the housing;

wherein rotation of the drive shaft enables driving motion of the pinion gear and the drive gear to enable rotation of the second detachable power-driven scrubber connected thereto for cleaning at least one of the object or another object.

8. The glove of claim 1, further comprising at least a pair of lock nuts to lock the first pulley and the second pulley at the first end and the second end of the drive shaft respectively.

9. The glove of claim 1, wherein position of the outlet is oriented in at least one direction of the first power-driven scrubber being operated.

10. The glove of claim 1, wherein the first detachable power-driven scrubber further comprises one or more drain holes, wherein the one or more drain holes are configured to drain at least one of liquid particles and dirt particles deposited in the cutout.

* * * * *